United States Patent [19]

Martin et al.

[11] Patent Number: 4,724,303

[45] Date of Patent: Feb. 9, 1988

[54] INSTANT-ON FUSER

[75] Inventors: Robert G. Martin; Steven B. Bolte, both of Rochester; Richard F. Koehler, Jr., Webster, all of N.Y.

[73] Assignee: Xerox Corporation, Stamford, Conn.

[21] Appl. No.: 893,753

[22] Filed: Aug. 6, 1986

[51] Int. Cl.[4] ..... G03G 15/20

[52] U.S. Cl. ..... 219/216; 219/543; 355/3 FU; 432/60

[58] Field of Search ..... 219/216, 469, 244, 471, 219/543; 355/3 FU; 432/60

[56] References Cited

U.S. PATENT DOCUMENTS

| | | | |
|---|---|---|---|
| 3,256,002 | 6/1966 | Hudson | 263/3 |
| 3,268,351 | 8/1966 | Van Dorn | 117/21 |
| 3,471,683 | 10/1969 | Bogue | 219/469 |
| 3,498,596 | 3/1970 | Moser | 263/6 |
| 3,669,706 | 6/1972 | Sanders et al. | 117/21 |
| 3,874,892 | 4/1975 | McInally | 117/6 |
| 3,898,424 | 8/1975 | Thettu | 219/216 |
| 3,948,214 | 4/1976 | Thettu | 118/60 |
| 3,953,709 | 4/1976 | Elter | 219/216 |
| 4,064,933 | 12/1977 | Schuman | 219/469 X |
| 4,355,255 | 10/1982 | Marsh | 219/216 |

*Primary Examiner*—R. L. Moses

*Attorney, Agent, or Firm*—Ronald F. Chapuran

[57] ABSTRACT

The present invention is concerned with an instant-on fuser having a cylindrical, relatively thin metal cylinder supporting a resistance heating foil or printed circuit secured on the inside surface of the cylinder by a high temperature adhesive. The interior of the cylindrical tube is filled with air. The heating foil or printed circuit is carried on a fiber glass substrate and the heating elements is connected to electrical leads extending through caps on the ends of the cylindrical support. The relatively low thickness, low mass fuser and high temperature materials permit a relatively fast instant-on fuser.

4 Claims, 5 Drawing Figures

INSTANT-ON FUSER

This invention relates to an improved fuser apparatus, and more particularly to an instant-on fuser apparatus requiring no standby heating device.

BACKGROUND OF THE INVENTION

In order to fuse electroscopic toner material permanently onto a support surface by heat, it is usually necessary to elevate the temperature of the toner material to a point at which the constituents of the toner materials coalesce and become tacky. This heating causes the toner to flow to some extent into the fibers or pores of the support member. Thereafter, as the toner material cools, solidification of the toner material causes the toner material to become firmly bonded to the support member.

The use of thermal energy for fixing toner images onto a support member is well known. Several approaches to thermal fusing of electroscopic toner images have been described in the prior art. These methods include providing the application of heat and pressure substantially concurrently by various means, for example, a roll pair maintained in pressure contact, a flat or curved plate member in pressure contact with a roll, and a belt member in pressure contact with a roll.

Heat may be applied by heating one or both of the rolls, plate members or belt members. The fusing of the toner particles takes place when the proper combination of heat, pressure and contact time are provided. Typically, in such direct contact systems, the roller surface may be dry, i.e. no application of a release agent to the surface of the roller as described, for example, in U.S. Pat. Nos. 3,498,596 and 3,666,447. Alternatively, the fuser roll surface may be wetted with a release agent such as a silicone oil as described in U.S. Pat. Nos. 3,268,351 and 3,256,002. It is also known in the art to fuse toner images by the use of a flash fusing process, for example, as disclosed in U.S. Pat. No. 3,874,892. In such a process, a flash lamp is generally pulsed on for a very short period of time. It can be appreciated that since the lamp is pulsed or flashed for short period of time, a large amount of power must be used to accomplish the fusing of the toner particles. U.S. Pat. No. 3,471,683 shows a heater roll with a printed circuit heating element. However, the heater roll is relatively thick and the adhesive material not suitable for relatively high temperature operation.

Another method for fusing toner images to a substrate is radiant fusing. Radiant fusing differs from flash fusing in that in radiant fusing the radiant energy source, typically and infrared quartz lamp, is turned on during the entire fusing step rather than pulsed for a short period time as in flash fusing. Examples of radiant fuser apparatus is shown in U.S. Pat. Nos. 3,898,424 and 3,953,709. Such prior art radiant fusers are generally made of relatively heavy metallic construction which requires the constant use of a heating element to maintain the apparatus at standby temperature.

Such prior art fusing systems have been effective in providing the fusing of many copies in relatively large, fast duplicating machines, in which the use of standby heating elements to maintain the machine at or near its operating temperature can be justified. However, there is a continuing need for an instant-on fuser which requires no standby power for maintaining the fuser apparatus at a temperature above the ambient. It is known to use a positive characteristic thermistor having a self temperature controlling property as a heater for a heating roller. The roller is regulated to a prescribed temperature by a heating control temperature detection element. It is known to employ radiation absorbing materials for the fuser roll construction to effect faster warm-up time as described in U.S. Pat. No. 3,669,706. It is also disclosed in U.S. Pat. No. 4,355,255 to use an instant-on radiant fuser apparatus made of a low mass reflector thermally spaced from a housing, with the housing and the reflector together forming a conduit for the passage of cooling air therein. A low mass platen is provided which is constructed to achieve an operating temperature condition in a matter of a few seconds without the use of any standby heating device. It is also known as disclosed in U.S. Pat. No. 3,948,214 to use a cylindrical member having a first layer made of elastomeric material for transporting radiant energy, a second layer for absorbing radiant energy, and a third layer covering the second layer to affect a good release characteristic on the fuser roll surface. The fuser roll layers are relatively thin and have an instant-start capability.

A difficulty with the prior art fusing systems is that they are often relatively complex and expensive to construct and/or the mass of the system is relatively large to preclude an instant-start fusing capability. It is an object of the present invention, therefore, to provide a new and improved instant-on fusing apparatus. It is another object of the present invention to provide an instant-on fuser apparatus that has a relatively low thermal mass and is designed for relatively ease of construction.

Further objects and advantages of the present invention will become apparent as the following description proceeds and the features of novelty characterizing the invention will be pointed out with particularity in the claims amended to and forming a part of this specification.

SUMMARY OF THE INVENTION

The present invention is concerned with an instant-on fuser having a cylindrical, relatively thin metal cylinder supporting a resistive heating foil or printed circuit secured on the inside surface of the cylinder by a high temperature adhesive. The interior of the cylindrical tube contains ambient air. The heating foil or printed circuit is carried on a fiber glass substrate and the heating element is connected to electrical leads extending through caps on the ends of the cylindrical support. The relatively low thickness, low mass fuser and high temperature materials permit a relatively fast instant-on fuser.

BRIEF DESCRIPTION OF THE DRAWINGS

For a better understanding of the present invention, reference may be had to the accompanying drawings, wherein the same reference numerals have been applied to like parts and wherein.

DESCRIPTION OF THE INVENTION

Figure 1:
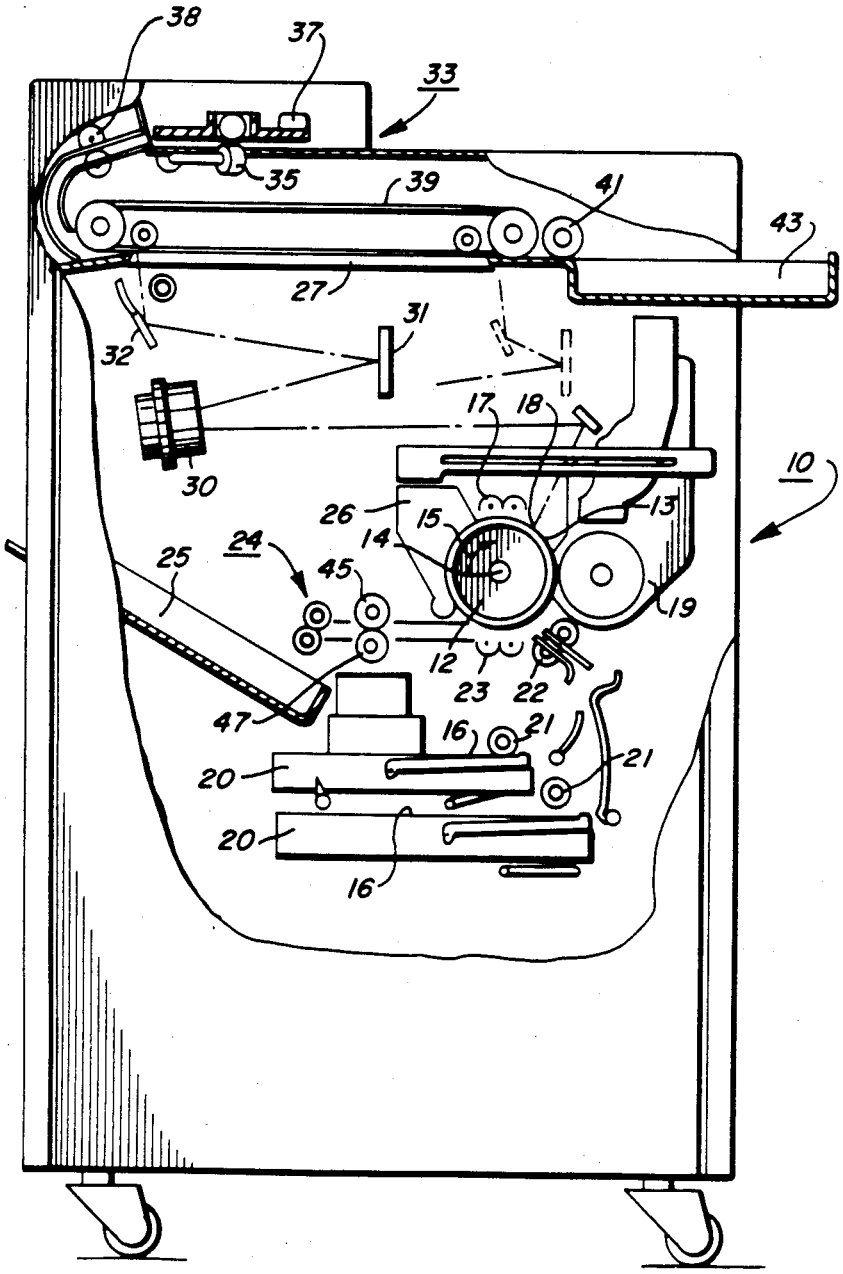
FIG. 1 is illustration of a reproduction machine incorporating the present invention.

Referring now to FIG. 1, there is shown by way of example an automatic xerographic reproducing machine 10 including an image recording drum-like member 12, its outer periphery coated with suitable photoconductive material or surface 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input information is recorded upon a sheet of final support material or copy sheet 16.

Initially, the drum 12 moves the photoconductive surface 13 through a charging station 17 providing an electrostatic charge uniformly over the photoconductive surface 13 in known manner preparatory to imaging. Thereafter, the drum 12 is rotated to exposure station 18 and the charged photoconductive surface 13 is exposed to a light image of the original document to be reproduced. The charge is selectively dissipated in the light exposed regions to record the original document in the form of an electrostatic latent image. After exposure drum 12 rotates the electrostatic latent image recorded on the photoconductive surface 13 to development station 19 wherein a conventional developer mix is applied to the photoconductive surface 13 of the drum 12 rendering the latent image visible. Typically, a suitable development station could include a magnetic brush development system utilizing a magnetizable developer mix having coarse ferromagnetic carrier granules and toner colorant particles.

The sheets 16 of the final support material are supported in a stack arrangement on an elevating stack supporting tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16.

After the toner image has been transferred to the sheet of final support material or copy sheet 16, the copy sheet 16 with the image is advanced to fusing station 24 for coalescing the transferred powder image to the support material. After the fusing process, the copy sheet 16 is advanced to a suitable output device such as tray 25.

Although a preponderance of toner powder is transferred to the copy sheet 16, invariably some residual toner remains on the photoconductive surface 13. The residual toner particles remaining on the photoconductive surface 13 after the transfer operation are removed from the drum 12 as it moves through a cleaning station 26. The toner particles may be mechanically cleaned from the photoconductive surface 13 by any conventional means, as for example, by the use of a cleaning blade.

Normally, when the copier is operated in a conventional mode, the original document to be reproduced is placed image side down upon a horizontal transparent platen 27 and the stationary original then scanned by means of a moving optical system. The scanning system includes a stationary lens 30 and a pair of cooperating movable scanning mirrors, half rate mirror 31 and full rate mirror 32 supported upon carriages not illustrate.

A document handler 33 is also provided including registration assist roll 35 and switch 37. When a document is inserted, switch 37 activates registration assist roll 35 and the document is fed forward and aligned against a rear edge guide of the document handler 33. The pinch rolls 38 are activated to feed a document around 180° curved guides onto the platen 27 for copying. The document is driven by a platen belt transport including platen belt 39. After copying, the platen belt 39 is activated and the document is driven off the platen by the output pinch roll 41 into the document catch tray 43.

The fusing station 24 includes a heated fuser roll 45 and a back-up or pressure roll 47 forming a nip through which the copy sheets to be fused are advanced. The copy sheet is stripped from the fuser rolls 4 by suitable (not shown) stripper fingers. The pressure roll 47 comprises a rotating member suitably journaled for rotation about a shaft and covered with an elastomeric layer of silicone rubber. The fuser roll 45 comprises a rotating cylindrical member 48 mounted on a pair of end caps 49 as seen in FIG. 2.

To be instant-on, a fuser sould achieve operating temperatures in a time shorter than the arrival time of the paper at the fuser, approximately 5 seconds as a warm-up time. The temperature rise is of the order of a 120° C. to 160° C. for a roller-type fuser. Raising the temperature of a rigid structure at a change of temperature of approximately 120° C. in five seconds using reasonable power levels, for example, 700 watts, requires a small mass to be heated.

Figure 3:
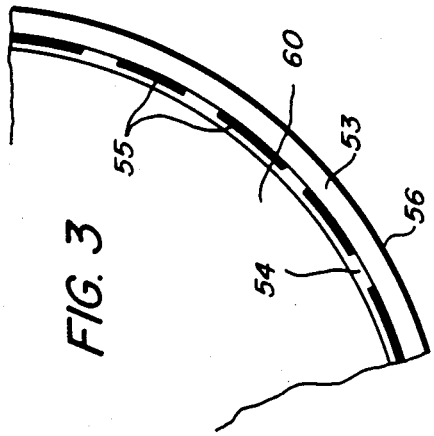
FIG. 3 is a cross-sectional view of the apparatus of FIG. 2
Figure 2:
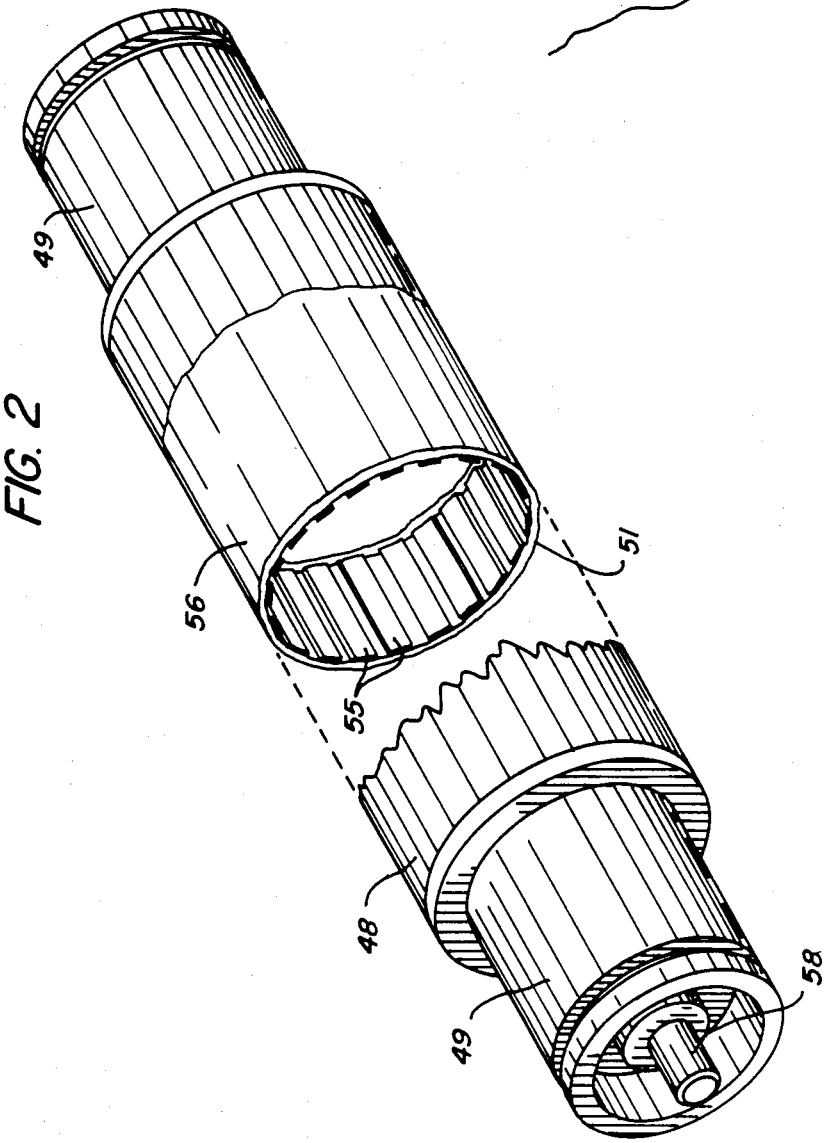
FIG. 2 is an isometric view of the instant-on fuser apparatus incorporated in FIG. 1 in accordance with the present invention.

With reference to FIGS. 2 and 3, in accordance with the present invention, the cylindrical member 48 is a hollow cylinder 51 of nickel or any other suitable metallic material of sufficient mechanical strength. Preferably, the thickness of the cylindrical tube wall 53 is approximately 4 mils. Disposed around the inside surface 54 of the cylinder 51 is a 1 mil printed circuit 55.

Figure 4:
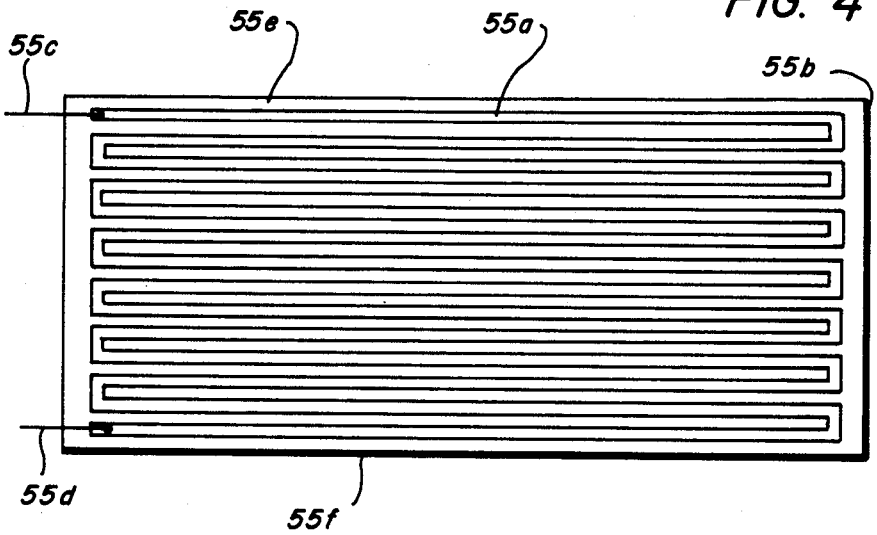
FIG. 4 illustrates a typical printed circuit.

With reference to FIG. 4, a typical printed circuit 55 includes a conductive path **55*a* of suitable conductive material on a substrate backed by fiberglass, Kapton, Nomex, or any other suitable insulating material 55*b*. The opposite ends 55*c* and 55*d* of the conductive path 55*a* are connected to conductor 58. The legs of the conducting path are equally spaced apart so that a relatively uniform heat source is created when the backing insulting material is formed into a cylindrical shape. The cylindrical shape is formed by bringing edges 55*e* and 55*f* into opposing relationship. Preferably, the combination of the hollow cylinder 51 and the printed circuit 55 provides the necessary mechanical strength to accommodate the diameter and tube length of the cylinder 51. A high temperature adhesive sealant layer, for example, polyimide, polyamidimide or suitable adhesive that is effective as an adhesive up to at least 400° F., secures the printed circuit 55 to the inside surface 54. It is essential to have a high temperature adhesive that is resistant to aging and high temperature. Preferably, covering the outside surface 56 of the cylinder 51 is a toner release material such as PFA or silicone rubber. The release material contacts the support sheet bearing toner images and prevents image offset to effect high quality fusing of copy sheets. Suitable electrical leads 58** connected to the printed circuit 55 extend through the end cap 49 for connection to an electrical power supply. The overall thickness of the cylindrical member with printed circuit, and adhesive is approximately 10 mils.

Generally, the pressure roll 47 is covered with a silicone rubber of a relatively low pressure or durometer rating. The relatively low mas of the cylindrical member 48 allows a pressure roll 47 with a relatively low durometer rubber covering. This permits a larger nip and less pressure between the fuser and pressure rolls. For example, typically in the prior art, there would be a ⅛ to 3/16 inch nip between the fuser and pressure rolls 45, 47 with an approximtely 40 durometer rubber sleeve on the pressure roll, giving a 100 psi (pounds per square inch) pressure; between the rolls.

However, in the present invention, typically the low mass and rubber sleeve of approximately 15 durometer, a ⅜ inch nip and approximately a 10 pound per square inch pressure is achieved. Obviously, less pressure and a wider nip results in a more efficient, reliable and longer lasting fusing operation.

In operation, heat is generated by the printed circuit 55 or any other suitable foil or film heater and is transmitted through the relatively thin, low mass tube wall 55 of the cylinder 51 to the outer surface 56.

Another aspect of the present invention is the fabrication of the low mass hollow cylinder 51 by an electron form process to produce a less than 10 mil wall thickness, not generally available in standard tubing stock. The hollow interior 60 of the cylinder is preferably insulated with air to prevent the loss of heat from the printed circuit 55 to the interior of the cylinder 51.

In accordance with another aspect of the invention, the heated fuser roll 45 is fabricated by first cutting suitable sections of thin walled nickel tubing in accordance with the size of the copy sheets to be fused. The high temperature adhesive is applied to the inside surface 54 of the nickel tubing and a roll of open weave fiberglass supporting a printed circuit 55 is inserted into the inside of the cylinder 51. The open weave acts as a lock between the printed circuit 55 and the inside surface of the cylinder. That is, the tiny air holes in the weave allow the adhesive to squeeze through to the inner wall 54 of the cylinder 51 locking the weave and the printed circuit to the inner wall. It should be noted that it is within the scope of the present invention that individually activated, discrete printed circuits could be assembled into the cylinder 51 to allow the selective fusing of copy sheets of different widths such as 8½×11 inch, 11×17 inch, and A3 and A4 size sheets. An air bag is then inserted within the cylinder 51 and air pressure applied to press the printed circuit 55 into engagement with the inner wall 54 of the cylinder 51. The assembly is then cured in a suitable oven. The high temperature adhesive secures the printed circuit 55 to the inside surface 54.

Figure 5:
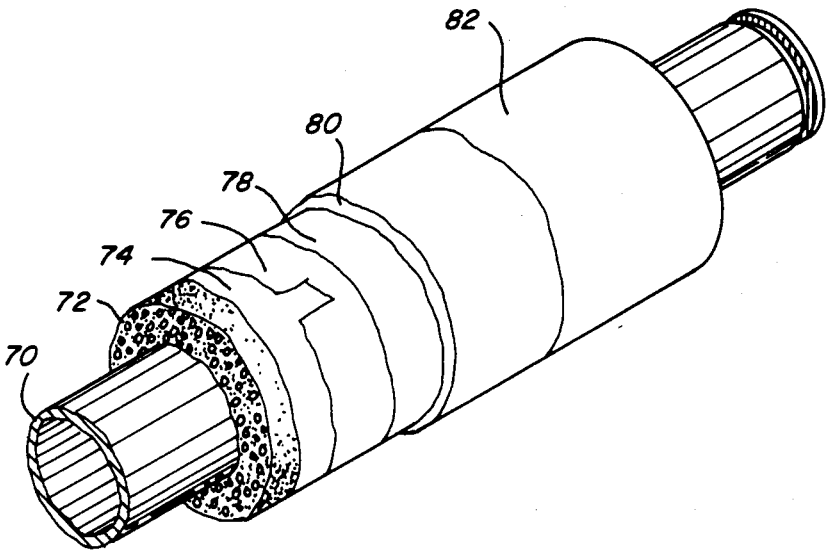
FIG. 5 is an alternative embodiment of an instant-on fuser.

With reference to FIG. 5, there is shown an alternate embodiment of a heated fuser roll. In particular, a hollow support shaft 70 supports foam or Nomex honeycomb core 72 of approximately one-half inch thickness. Attached to the foam core 72 is a substrate 74 carrying a foil or film heater 76. Suitable adhesive 78 secures the substrate and film heater to the metallic tube 80. A suitable release material 82 is coated on the outside surface of the metallic tube 80. Again, heat is delivered through the foil or film heater and the 2 mil adhesive layer electrically insulates as well as attaches the film heater to the tube 80. The tube 80 is approximately 2 mils thick and serves to smooth the temperature fluctuations and provides sufficient thermal mass for heating the copy sheets to the appropriate fusing temperature. The outer release layer prevents toner adhesion to the metallic tube. The film heater is supported preferably on a polymeric substrate of approximately 4 mils thickness. In turn, the substrate is supported by the foam core which is preferably of low thermal conductivity and low thermal mass.

While there has been illustrated and described what is at present considered to be a preferred embodiment of the present invention, it will be appreciated that numerous changes and modifications are likely to occur to those skilled in the art, and it is intended in the appended claims to cover all those changes and modifications falling within the true spirit and scope of the present invention.

What is claimed is:

1. In an electrostatic copying machine having pressure fusing apparatus of the type including an instantly heated fuser roll and a pressure back-up roll defining a nip through which support material bearing toner images is passed for fusing the toner images onto the support material, an instantly heated fuser roll comprising:

a hollow, relatively thin, cylindrical member made of nickel, the cylindrical member having an outside and an inside surface and being less than 10 mils thick, and a source of heat energy affixed by a high temperature adhesive to the inside surface of said cylindrical member, the high temperature adhesive being effective up to 400° F., the source of thermal energy being a heating circuit element, the combined thickness of the cylindrical member, the heating circuit element and the adhesive being less than 0.015 inches.

2. The heated fuser roll of claim 1 wherein the hollow cylindrical member comprises ambient air.

3. The heated fuser roll of claim 2 wherein the heating circuit element is a 1 mil printed circuit element.

4. The heated fuser roll of claim 3 wherein the substrate is Kapton, Nomex, or fiber glass.

* * * * *